US007883376B2

(12) United States Patent
Milette et al.

(10) Patent No.: US 7,883,376 B2
(45) Date of Patent: Feb. 8, 2011

(54) CONNECTOR WITH INSULATION PIERCING CONTACT FOR TERMINATING PAIRS OF BONDED CONDUCTORS

(75) Inventors: Luc Milette, Montreal (CA); François Beauregard, Laprairie (CA); Yannick Demers, St-Jean Sur Le Richelieu (CA); Virak Siev, Montreal (CA); Patrick St-Louis, Boisbriand (CA)

(73) Assignee: Belden CDT (Canada) Inc., Saint-Laurent (CA)

( * ) Notice: Subject to any disclaimer, the term of this patent is extended or adjusted under 35 U.S.C. 154(b) by 0 days.

(21) Appl. No.: 12/691,777

(22) Filed: Jan. 22, 2010

(65) Prior Publication Data

US 2010/0124855 A1 May 20, 2010

Related U.S. Application Data

(63) Continuation of application No. 12/184,474, filed on Aug. 1, 2008, now Pat. No. 7,670,193.

(60) Provisional application No. 60/953,318, filed on Aug. 1, 2007.

(51) Int. Cl.
*H01R 24/00* (2006.01)

(52) U.S. Cl. ..... 439/676

(58) Field of Classification Search ..... 439/676, 439/404, 941, 405

See application file for complete search history.

(56) References Cited

U.S. PATENT DOCUMENTS 4,211,462 A 7/1980 Wolfthal
4,431,246 A 2/1984 Vaden
4,679,878 A 7/1987 Volk
5,147,215 A 9/1992 Pritulsky
5,194,014 A 3/1993 McClune et al.
5,417,583 A 5/1995 Ishizaki et al.
6,000,952 A * 12/1999 Gladd et al. ..... 439/76.2
6,010,353 A 1/2000 Ensz et al.
6,368,144 B2 4/2002 Viklund
6,371,793 B1 4/2002 Doorhy et al.
6,488,525 B2 12/2002 Abel et al.
6,749,456 B1 6/2004 Conner et al.
7,150,657 B2 12/2006 Quenneville et al.
7,249,962 B2 7/2007 Milette et al.
7,670,193 B2 * 3/2010 Milette et al. ..... 439/676
2005/0153603 A1 * 7/2005 AbuGhazaleh et al. ..... 439/676
2007/0042635 A1 2/2007 Quenneville et al.

* cited by examiner

*Primary Examiner*—Chandrika Prasad
(74) *Attorney, Agent, or Firm*—Goudreau Gage Dubuc; Hugh Mansfield

(57) ABSTRACT

There is disclosed a connector and method for terminating a cable comprised twisted pairs of conductors. In one aspect of the invention the connector comprises a wire lead guide for arranging the twisted pairs of conductors and a plurality of piercing contacts which interconnect with respective ones of the twisted pairs of conductors when the wire guide is secured to the module. In a further aspect of the invention the wire lead guide ensures that the spacing between the conductors of a particular twisted pair is maintained, thereby improving the performance of the subsequent assembly.

8 Claims, 19 Drawing Sheets

CONNECTOR WITH INSULATION PIERCING CONTACT FOR TERMINATING PAIRS OF BONDED CONDUCTORS

CROSS REFERENCE TO RELATED APPLICATIONS

This application is a continuation application of U.S. patent application Ser. No. 12/184,474, filed on Aug. 1, 2008, now U.S. Pat. No. 7,670,193 now allowed. This application claims benefit, under 35 U.S.C. §119(e), of U.S. provisional application Ser. No. 60/953,318, filed on Aug. 1, 2007. All documents above are incorporated herein in their entirety by reference.

FIELD OF THE INVENTION

The present invention relates to a connector with insulation piercing contacts. In particular, the present invention relates to a connector for terminating a telecommunications cable comprising a plurality of twisted pairs of wires, where contact terminals are positioned such that the separation between the contact pairs is substantially the same as the spacing between individual wires of a pair.

BACKGROUND OF THE INVENTION

The prior art reveals a plurality of telecommunication connectors for terminating telecommunications cables comprising a plurality of twisted pairs of wires. Many of these connectors use Insulation Displacement Contacts (IDCs), which, although they allow for multiple terminations on the same connector, prove unsuitable for maintaining the distance between individual conductors of a pair, an important factor for improving signal performance. Moreover, the use of IDCs to terminate conductors typically results in connectors necessitating specific tools for termination.

To overcome these and other drawbacks of IDCs, some connectors use Insulation Piercing Contacts (IPCs), which perforate the conductors' outer insulating cover to provide electrical contact. Insulation piercing technology allows for multiple contacts to be positioned on the same row, thus providing for smaller-sized connectors with improved performance. Still, in most prior art connectors using insulation piercing technology, wires to be terminated typically run in parallel and end portions of the twisted pairs of wires are isolated from one another and aligned with the respective contact terminals using accessories such as wire guides. These wire guides are typically disposed between the end of the cable jacket and the connector's insulated housing and comprise a plurality of longitudinally extending parallel channels, which receive the wires. One major drawback is that, as the point of insertion of individual conductors into the connectors is arranged along a parallel line, unwanted cross-talk and the like may arise, thus reducing the connectors' performance, especially at high frequencies. Moreover, the separation between the conductors of a twisted pair is not rigorously maintained.

Consequently, there exists a need for a connector, which uses insulation piercing technology and ensures that contact terminals are positioned such that the separation between the contact pairs is substantially the same as the spacing between individual wires of a pair.

SUMMARY OF THE INVENTION

In order to address the above and other drawbacks, there is provided an electrical connector for terminating a cable comprising a bonded twisted pair of conductors, each conductor of the at least one twisted pair of conductors comprising an insulation surrounding a conductive core. The connector comprises a housing defining an elongate passage configured for receiving the bonded twisted pair of conductors and a pair of contacts in the housing, each of the pair of contacts projecting into the elongate passage, piercing the insulation and contacting the conductive core of a respective one of the pair of conductors.

DETAILED DESCRIPTION OF THE ILLUSTRATIVE EMBODIMENTS

Figure 1:
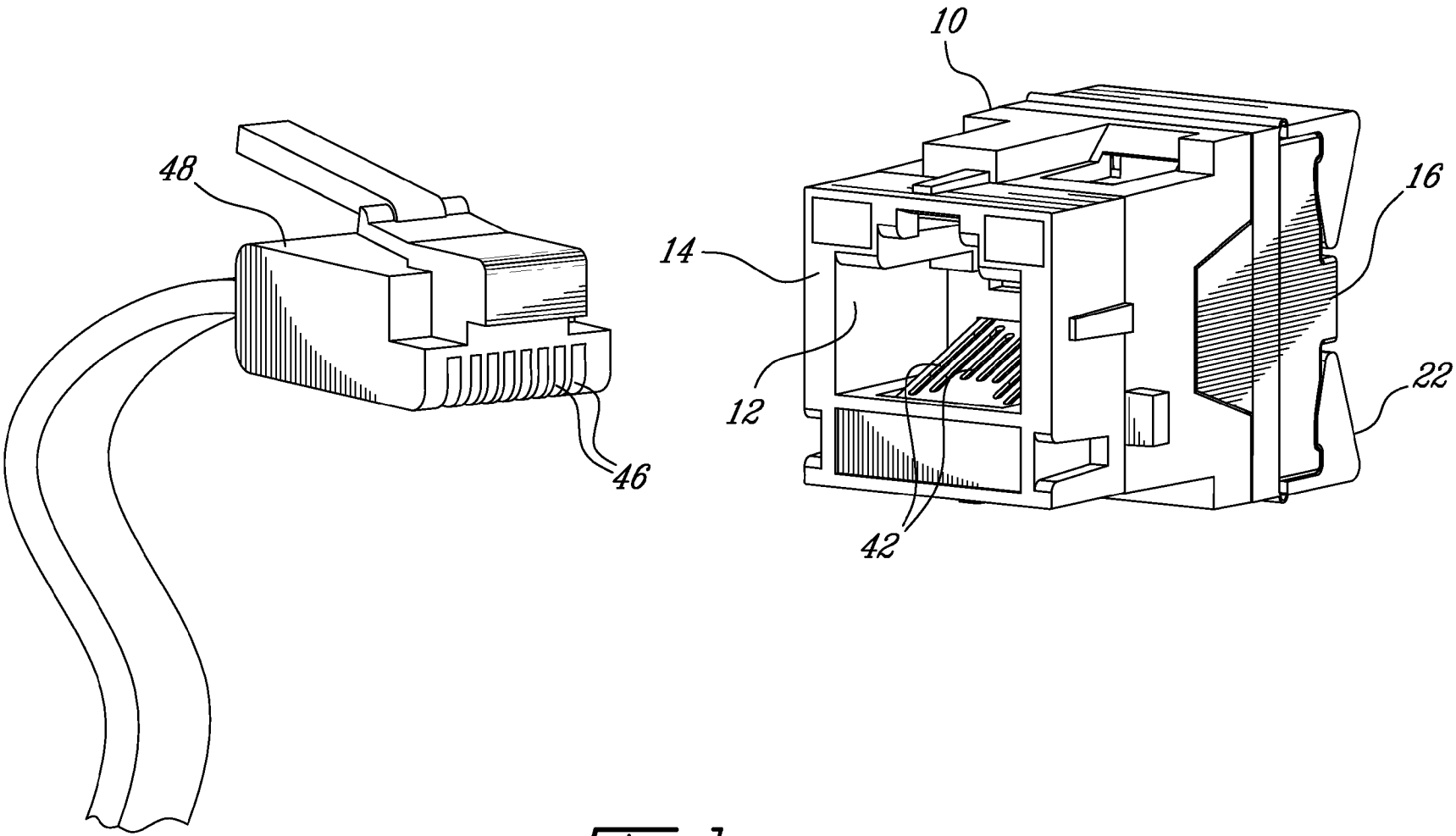
FIG. 1 is a right front perspective view of an interconnection module with insulation piercing contact and cable plug in accordance with an illustrative embodiment of the present invention.

Referring now to FIG. 1, an electrical connector with insulation piercing contact, generally referred to using the reference numeral 10, will now be described. The connector 10 is used to terminate a telecommunications cable (not shown) consisting of a plurality of twisted pairs of conductors (typically four (4), all not shown). The connector 10 comprises a receptacle 12 formed in a front face 14 thereof, for example a receptacle conforming to the RJ-45 standard.

Figure 2:
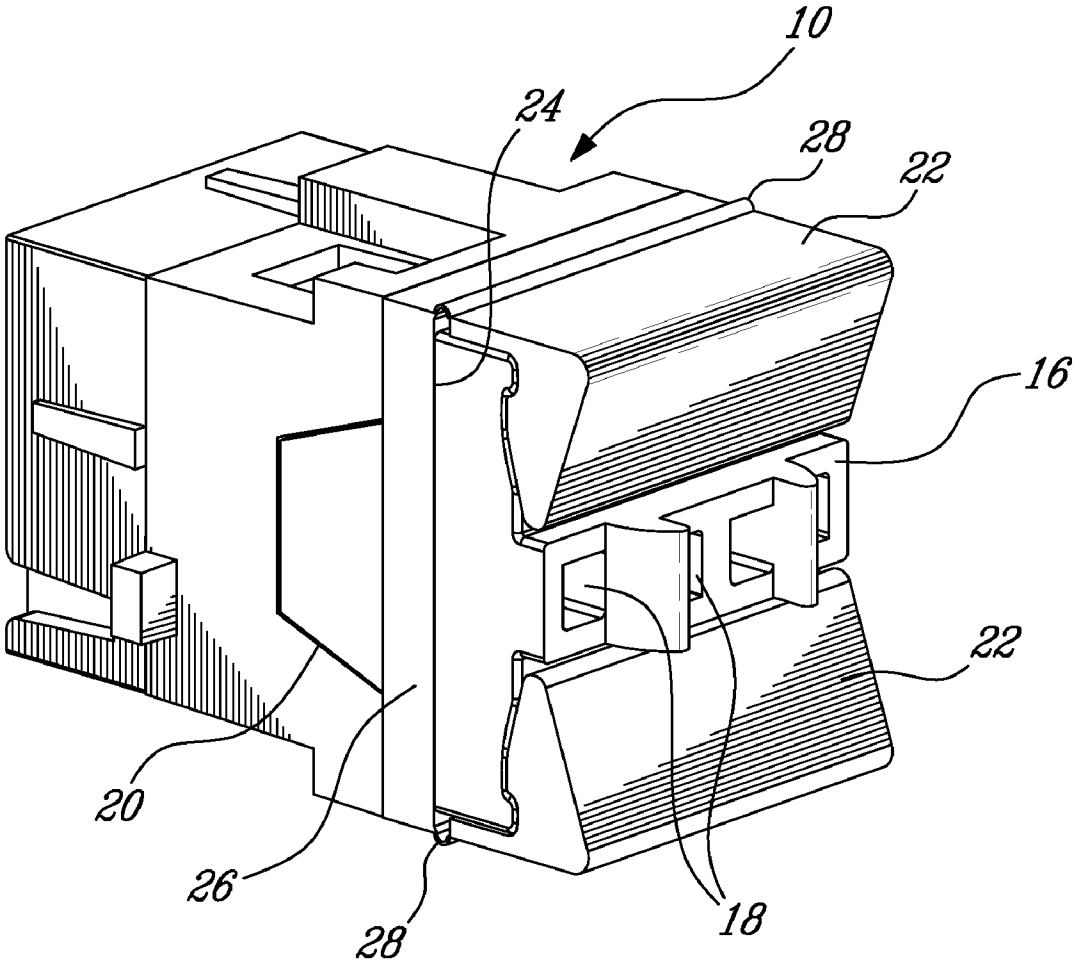
FIG. 2 provides a left rear raised perspective view of the interconnection module of FIG. 1.

Referring now to FIG. 2, the connector 10 further comprises a wire guide 16 comprising a plurality of twisted pair receiving channels as in 18 moulded or otherwise formed therein. A locking mechanism 20 comprising a pair of latches 22 is provided to retain the wire guide 16 snugly against a substantially flat wire lead guide receiving surface 24 of the connector 10 when engaged. Each of the latches 22 is attached along an edge of the base 26 of the locking mechanism by a respective flexible hinge as in 28 about which the latches as in 22 can pivot.

Figure 3:
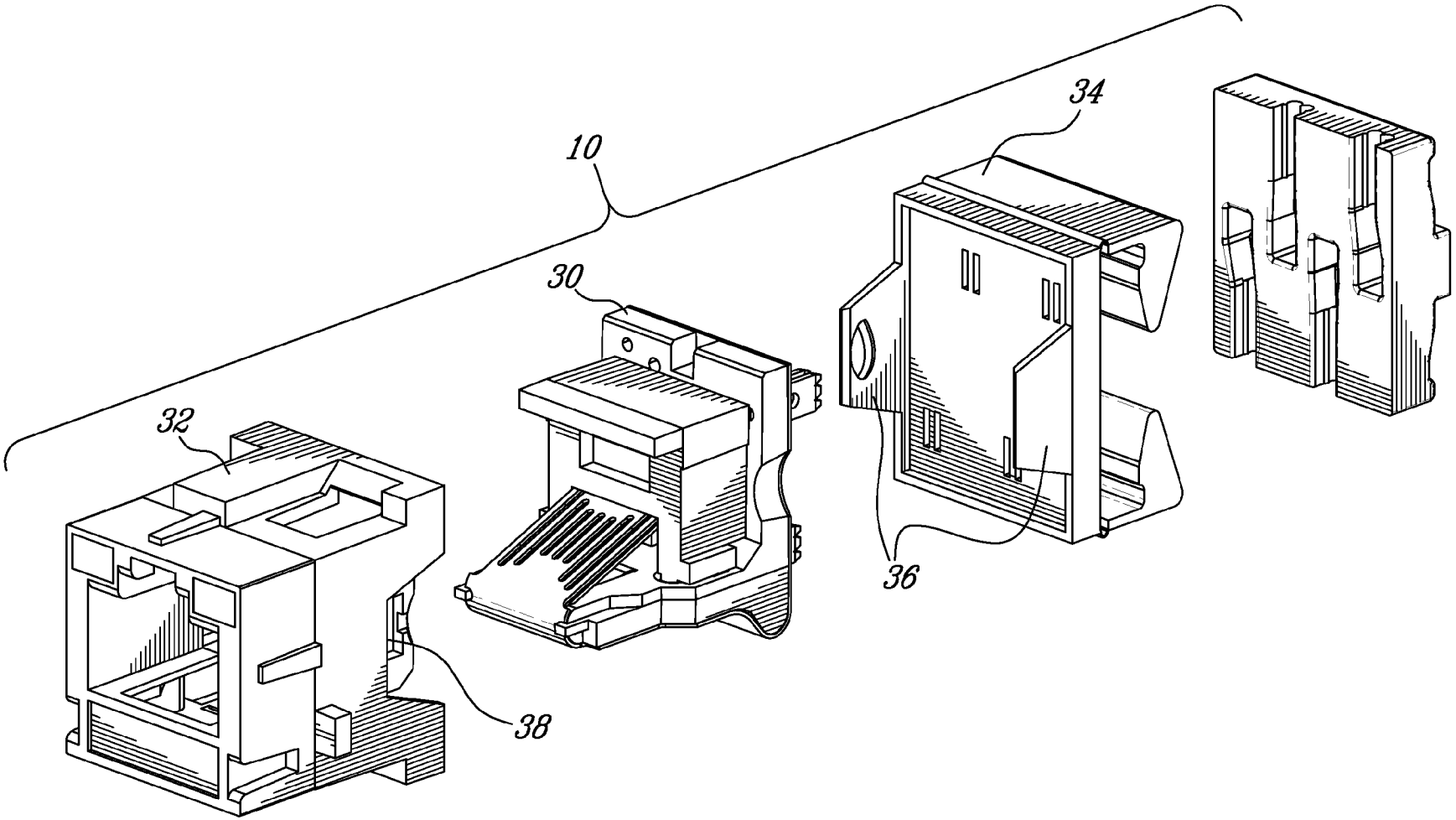
FIG. 3 provides a right front perspective exploded view of the interconnection module of FIG. 1.

Referring now to FIG. 3, the interconnector 10 comprises an interconnection/termination module 30 which is encased in hollow housing formed by a forward housing portion 32 and a rearward housing portion 34. Through the provision of a pair of raised tabs as in 36 on the rearward housing portion 34 and respective tab receiving indentations as in 38 forward housing portion 32, the forward housing portion 32 and a rearward housing portion 34 can be snap fit together such that the interconnection module 30 module is securely encased therein.

Figure 4A:
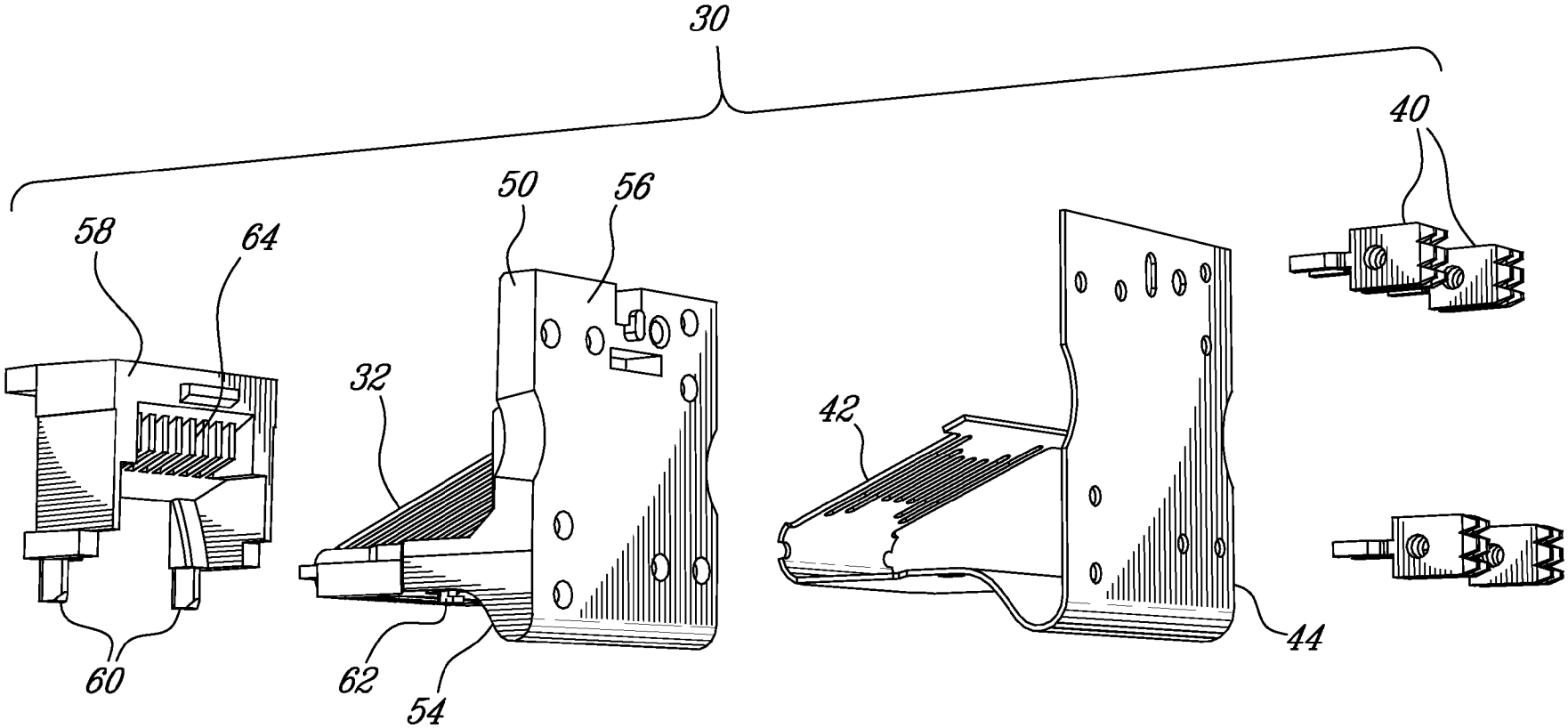
FIGS. 4A and 4B provide respectively an exploded left lowered rear perspective view and an exploded right raised front perspective view of an interconnecting portion of the interconnection module of FIG. 1.
Figure 4B:
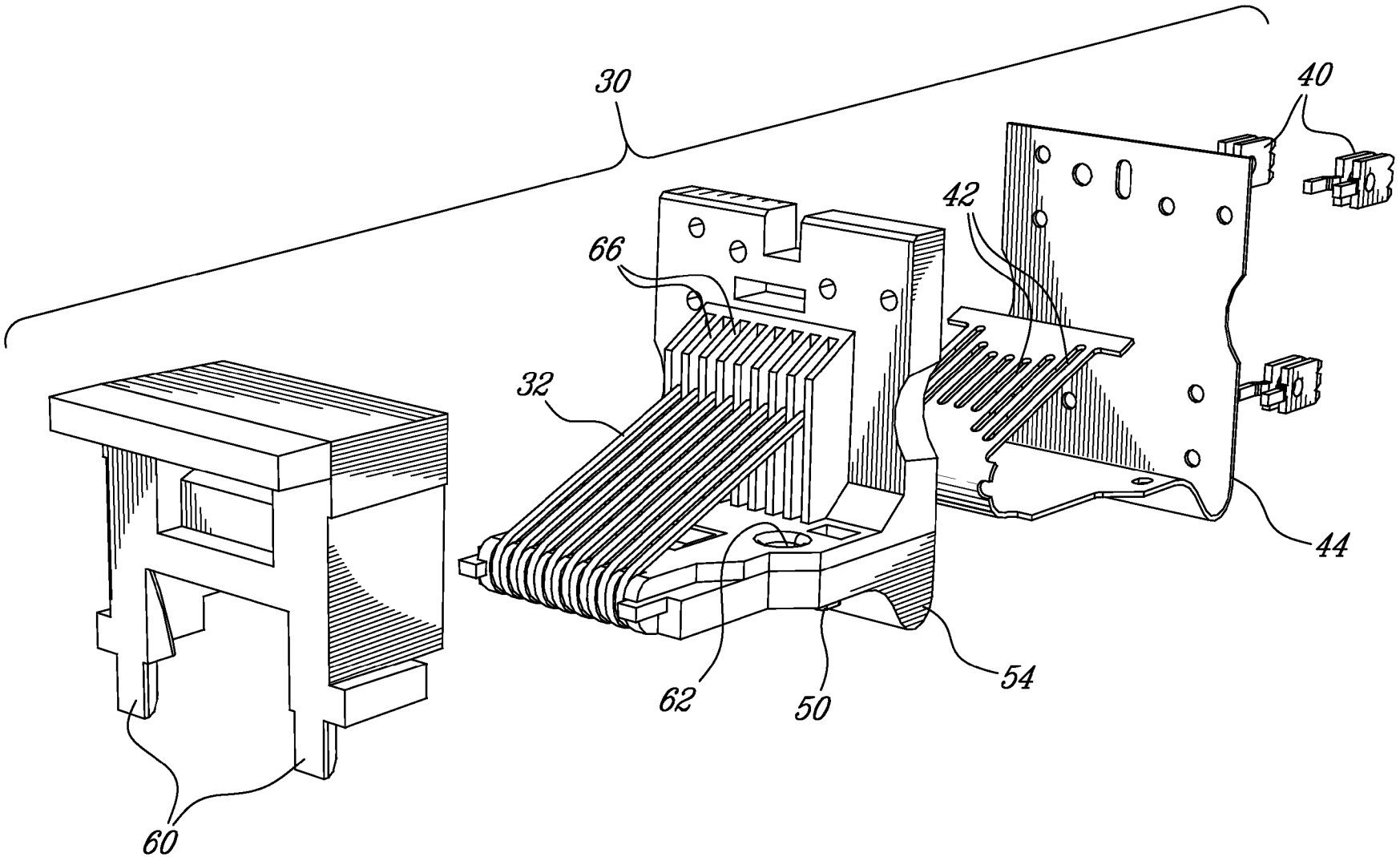

Referring now to FIGS. 4A and 4B, the interconnection module 30 comprises a plurality of Insulation Piercing Contacts (IPCs) 40 which are each interconnected with a corresponding conductive tine as in 42 via a conductive path (not shown). Illustratively, a flexible Printed Circuit Board (PCB) 44 is provided for interconnecting the IPCs 40 with their respective conductive tines 42. As known in the art, using photo mask and an etching process the PCB 44 can be fabricated to include a multiple of non intersecting conductive paths between various points on or between either surface of the PCB 44. Referring back to FIG. 1 in addition to FIGS. 4A and 4B, as will be now apparent to a person of ordinary skill in the art, once the connector 10 has been assembled, the terminals 46 of a cable plug 48 inserted into the receptacle 12 will come into contact with a corresponding one of the conductive tines 42.

Still referring to FIGS. 4A and 4B, in order to ensure that the conductive tines 42 provide sufficient resilience when in contact with the contacts of a cable plug and provide support for the flexible PCB 44, a support assembly 50 is provided, illustratively comprised of a series of resilient yet flexible supporting members 52, fabricated for example from metal or plastic or the like, attached to a support base 54, fabricated for example from a dielectric material such as plastic. The support base 54 additional provides an IPC receiving surface 56 for receiving and supporting the IPCs 40. In order to retain the tines 42 of the flexible PCB 44 against the supporting members 52 and also limit the range of movement of the supporting members 52, a supporting member retainer 58 is provided. The supporting member retainer 58 comprises a pair of posts as in 60 which are adapted for insertion into a pair of post receiving bores 62 moulded or otherwise machined in the support base 54. Additionally, the supporting member retainer 58 comprises a plurality of raised tongues as in 64 which on assembly are received by a series of corresponding grooves 66, which also receive the ends of the supporting members 52, and thereby ensuring that the path and travel of the supporting members 52 is limited.

Figure 5A:
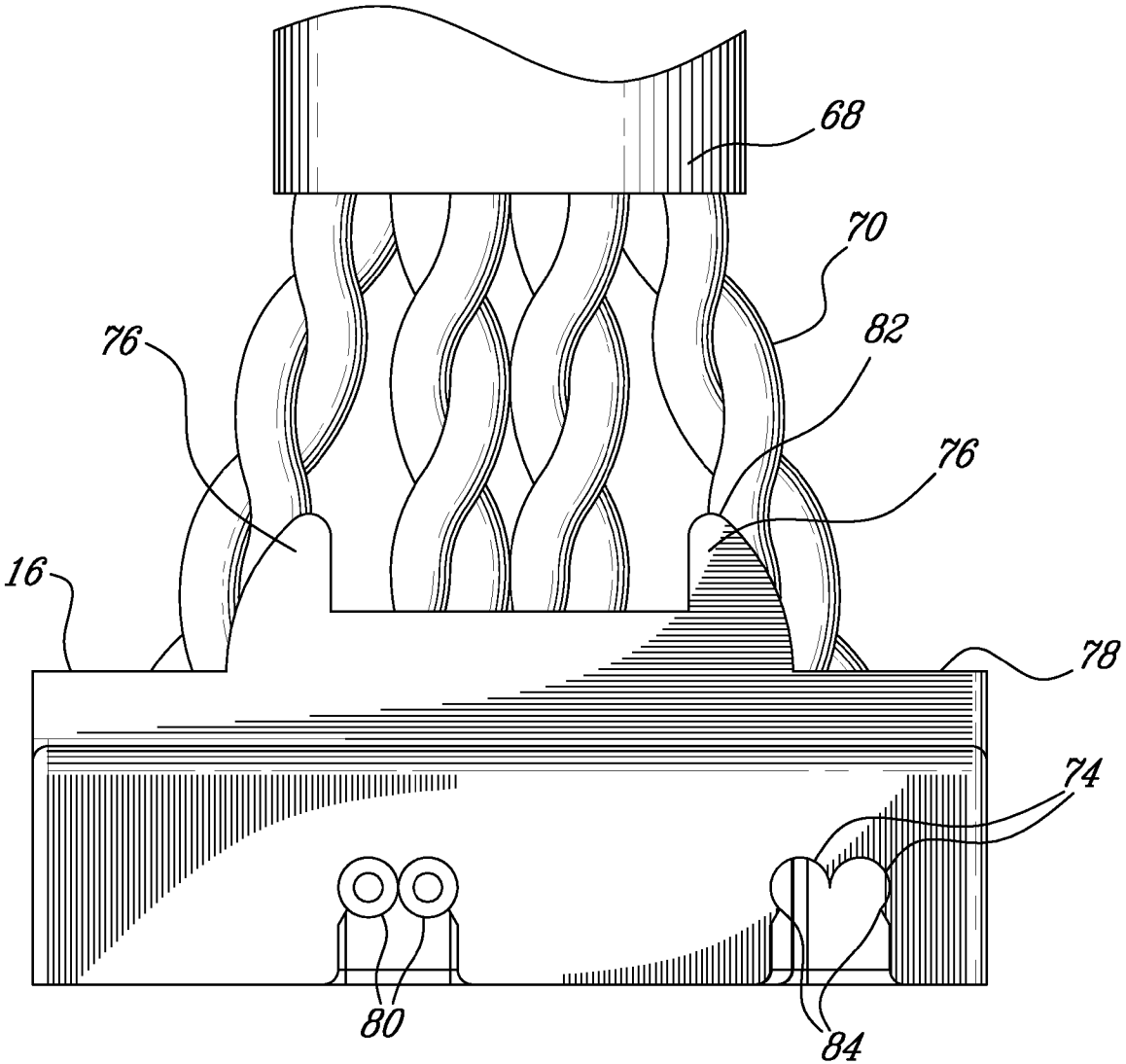
FIGS. 5A, 5B and 5C provide respectively side plan, top plan and bottom plan views of a wire lead guide in accordance with an illustrative embodiment of the present invention.
Figure 5B:
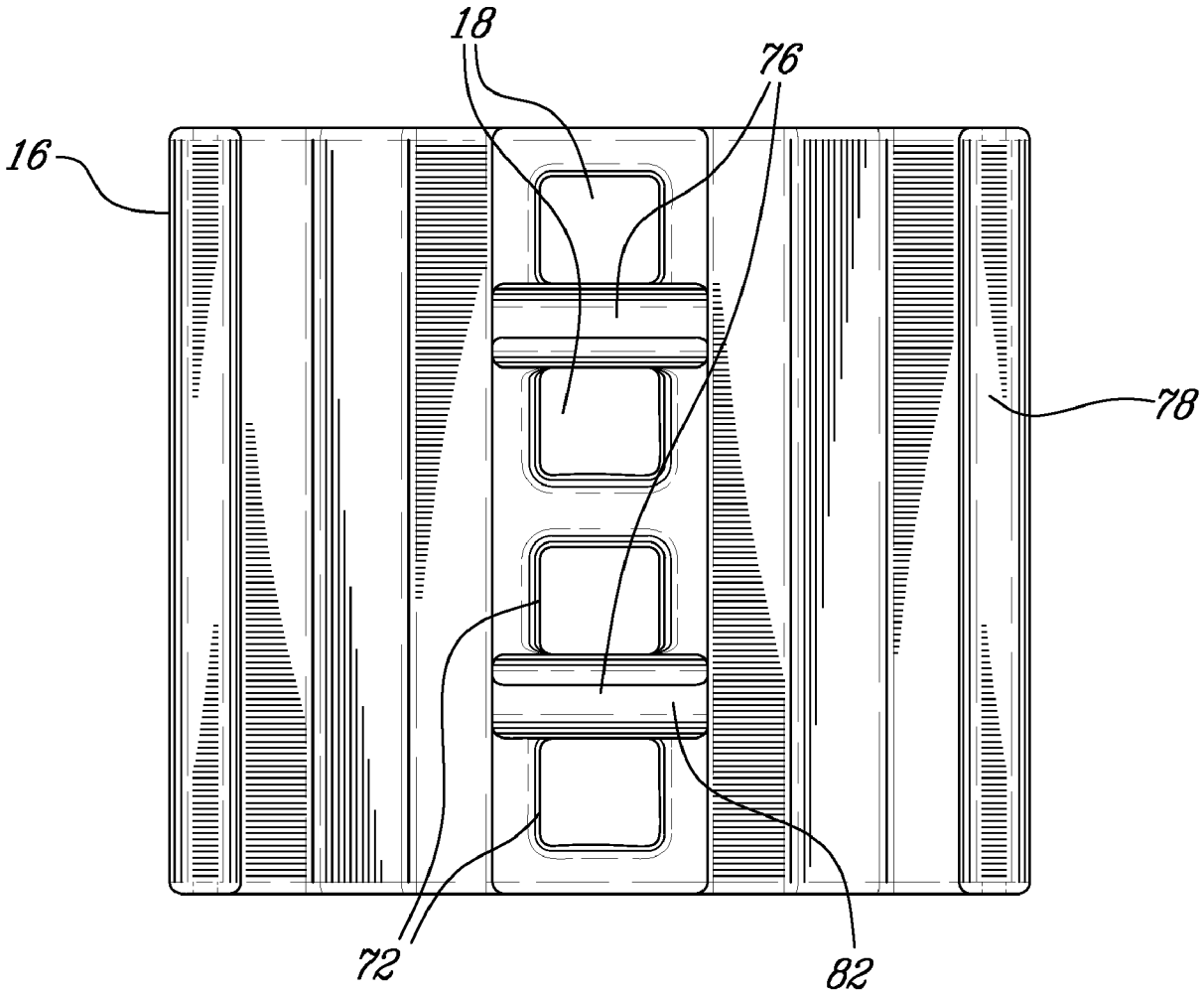
Figure 5C:
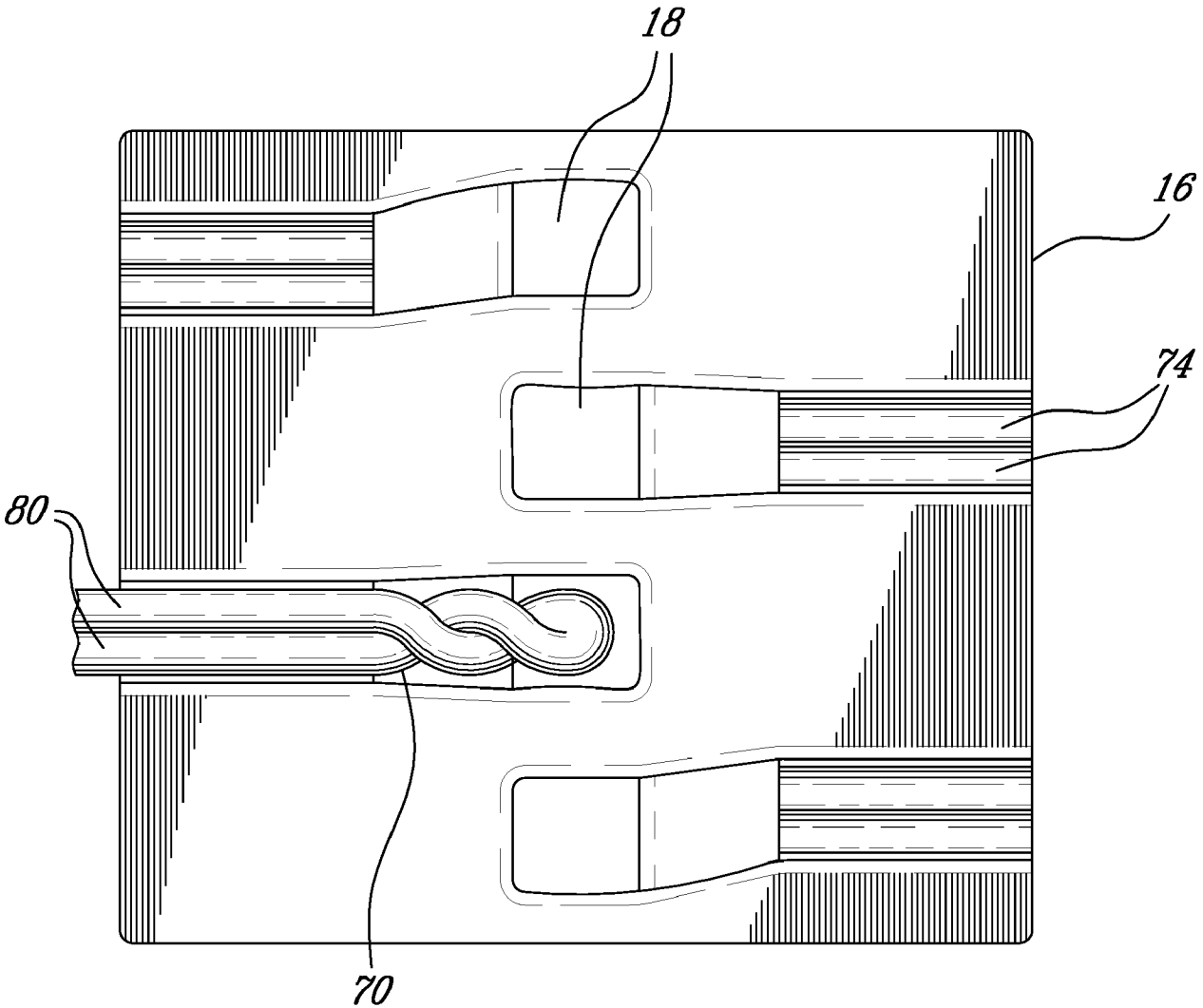

Referring now to FIGS. 5A, 5B and 5C, the wire guide 16 is adapted to mate with the end of a cable 68 illustratively comprised of four (4) twisted pairs of conductors 70, a respective one of which is received into each of the twisted pair receiving channels as in 18. Each receiving channel 18 is comprised of an entry 72 and a pair of adjacent profiled individual conductor receiving channels 74 arranged at right angles to the entry 72. Additionally, a pair of raised abutments as in 76 can be provided on an upper surface 78 of the wire lead guide 16. In operation, the ends 80 of a corresponding twisted pair of conductors as in 70 enter the wire guide 16 through the entry 72, bend at right angles and are arranged within their respective channel as in 74. By providing a smooth curved outer surface 82, the raised abutments as in 76 serve to separate as well as guide the twisted pairs as in 70 into their respective receiving channels as in 18.

Still referring to FIGS. 5A, 5B and 5C, the profile of the channel 74 serves to retain the ends 80 in place during installation and subsequent use of the connector 10. Additionally, bending of the wires into the channels 74 prevents the untwisting of the pairs through the wire lead guide 16 and underneath the jacket of the cable 68, thus reducing the portion of each twisted pair 70 which is untwisted, and improving the performance of the electrical transmission parameters of the connector 10. Additionally, the mechanical strength of the interconnection between the connector 10 and the cable 68 is greatly improved thereby reducing the chance that the twisted pairs of conductors 70 are inadvertently pulled away from the contacts 40. In order to better retain the individual wires within their respective channels 74, the channels 74 are provided with a pair of opposing ridges 84 which narrow the mouth of the channels 74.

Figure 6:
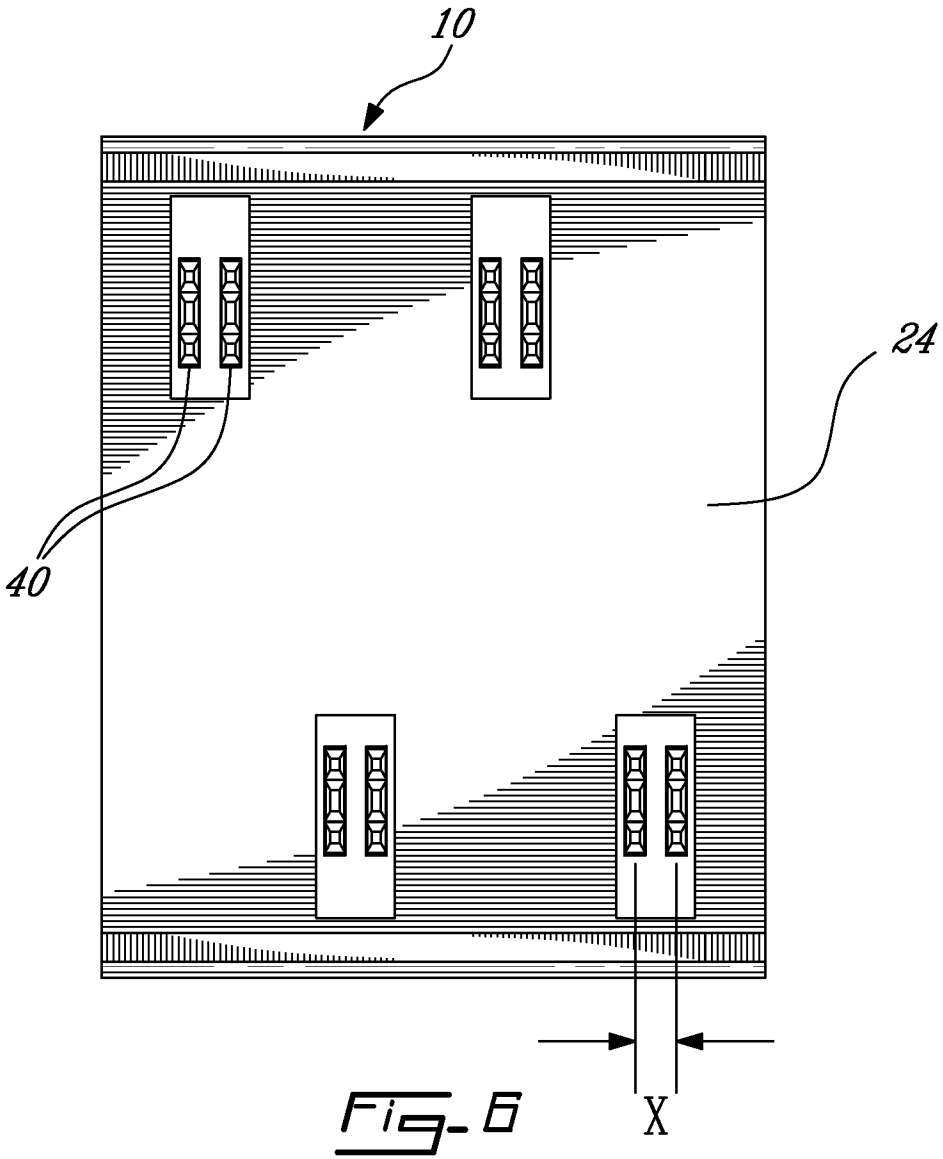
FIG. 6 provides a rear plan view with the wire lead guide removed of the interconnection module of FIG. 1.

Referring now to FIG. 6, with the wire guide 16 removed, the plurality of IPC contacts 40 are visible on the wire lead guide receiving surface 24 of the connector 10. The contacts as in 40 are arranged side by side in pairs with the spacing "x" between the contacts as in 40 the same or similar to that of the twisted pairs of conductors (reference 70 in FIG. 5A). As known in the art, the transmission of high quality high-frequency signals partly depends on each conductor of a twisted pair being maintained in a particular configuration. As a result, minimal spacing of the contacts 40 ensures that the spacing between individual conductors of a given twisted pair is maintained, thus preserving continuity of transmission between each pair of conductors and its respective contacts 40 and improving overall signal performance. The performance of the connector 10 is further enhanced by staggering the pairs of contacts 40, which reduces the extent to which a pair of contacts 40 terminating a given twisted pair of conductors interferes with another pair of contacts 40. Indeed, due to the small size of each insulation piercing contact 40, the pairs of contacts 40 may be positioned on the wire lead guide receiving surface 24 of the connector 10 on the same row or staggered, e.g. two pairs on two rows in quadrant or cross configuration, as illustrated.

Still referring to FIG. 6, each contact 40 is comprised of a piercing mechanism, illustratively a tri-point mechanism, comprised of a plurality of sharp teeth. Referring back to FIG. 5C in addition to FIG. 6, as the wire guide 16 is secured to the wire lead guide receiving surface 24 of the connector 10 with the twisted pairs of conductors as in 70 installed in their respective receiving channels 18, the insulated housing surrounding the individual conductors of the twisted pairs of conductors 70 is pierced by the teeth of a respective contact 40, thereby providing electrical contact between the conductive core of the conductor and the contact 40. In addition to ensuring that the distance between individual conductors 16 of a pair 14 can be rigorously maintained, as mentioned herein above, the piercing contacts 40 as configured have the advantage of enabling conductors 16 to remain twisted until just before they are pierced by the contacts 40, thus improving signal quality. The piercing mechanism also allows for a relatively compact placement of the contacts 40 such that the spacing between the conductors 16 as well as the overall size of the connector 10 are minimized, thus reducing the deteriorating effect of capacitance on any transmitted signals. The compact spacing between the contacts is of particular interest in applications using bonded insulation twisted pair conductors as described in U.S. Pat. No. 5,606,151 where the distance between the conductors in a given twisted pair is minimised.

Referring now back to FIG. 5A and FIG. 5C in addition to FIG. 6, once the twisted pairs as in 70 have been inserted into their respective receiving channel as in 18 and the individual wires from a twisted pair 70 bent perpendicularly such that their ends 80 lie within their respective channels 74, the wire lead guide 16 is then pressed onto the wire lead guide receiving surface 24 of the connector 10. In this manner, the individual wires of the twisted pairs of conductors as in 70 are interconnected with their respective contacts 40 and generally terminated at right angles to the longitudinal axis of the cable 68. With additional reference to FIG. 2 and as discussed above, in order to secure the wire lead guide 16 onto the wire lead guide receiving surface 24 of the connector 10, the latter is provided with a pair of latches 22, which secure the wire lead guide 16 the wire lead guide receiving surface 24 of the connector 10 by lever action. As will now be apparent to a person of skill in the art, the latches 22 force the wire lead guide 16 onto the wire lead guide receiving surface 24 of the connector 10 thereby locking it into place. This mechanism, together with the use of piercing technology, allows for a "tool-less" connector 10, where pressure ensures the contact and terminates all conductors of each twisted pair as in 70 simultaneously. As will be apparent to one of ordinary skill in the art, the wire lead guide 16 may be installed on the wire lead guide receiving surface 24 of the connector 10 either manually or using an adapted insertion tool and, a locking mechanism may then be used to lock and hold the wire lead guide 16 in place.

Figure 7:
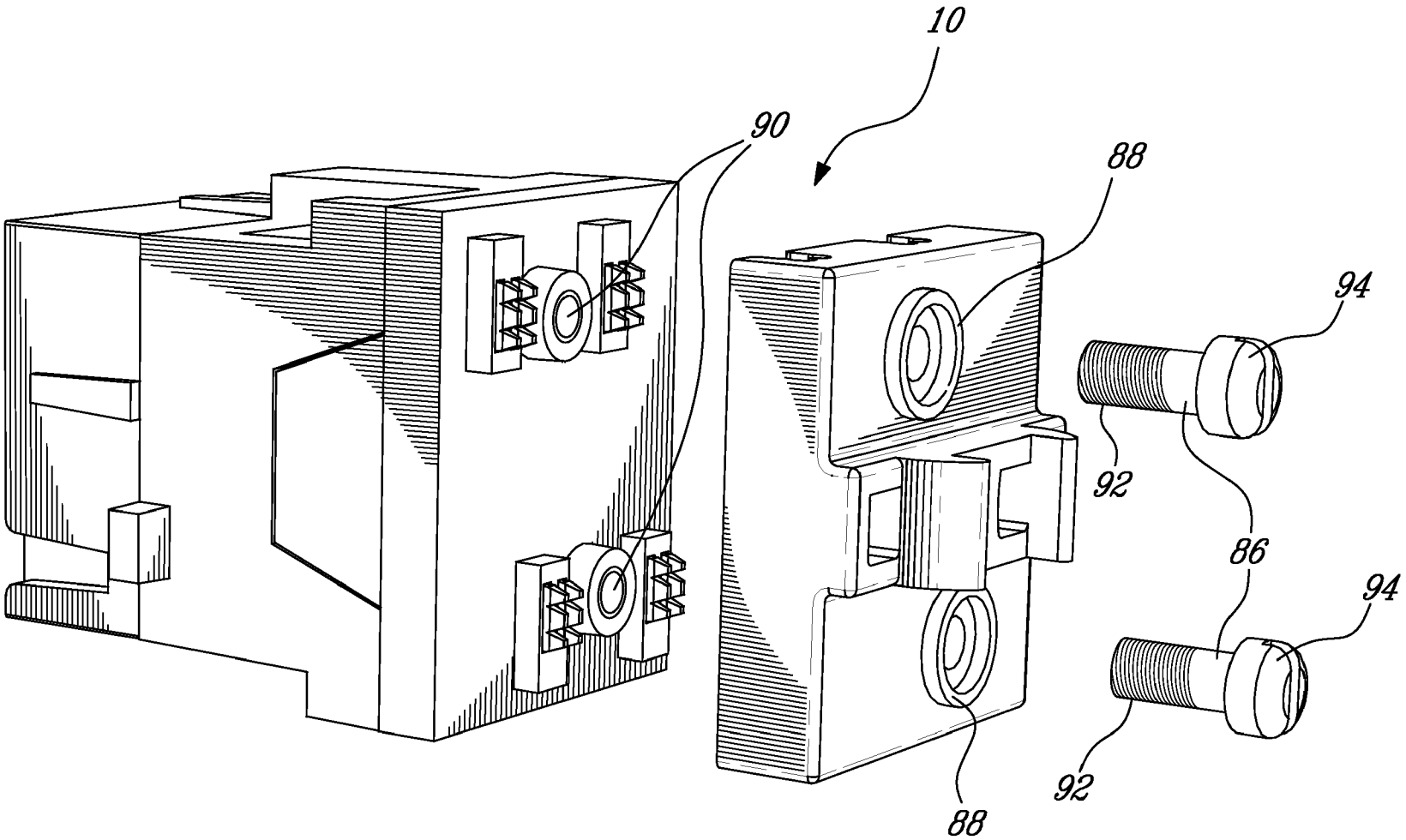
FIG. 7 provides a left raised partially exploded rear perspective view of an interconnection module with insulation piercing contact in accordance with a first alternative illustrative embodiment of the present invention.

Referring to FIG. 7, in a first alternative embodiment of the connector 10, the latches (reference 22 in FIG. 1) used for securing the wire lead guide 16 to the wire lead guide receiving surface 24 are replaced by a pair of threaded screws/bolts as in 86, a pair of apertures as in 86 formed in the wire lead guide 16 and corresponding threaded bores as in 90 moulded or otherwise formed (for example through the use of metal inserts press fit into apertures, all not shown, formed in the wire lead guide receiving surface 24) in the wire lead guide receiving surface 24 for receiving the threaded ends 92 of the bolts as in 86. Each bolt as in 86 further comprises a machined head as in 94 adapted for receiving a tool such as a screw driver or the like (not shown).

Referring back for example to FIG. 5C in addition to FIG. 7, in operation, and as will now be apparent to a person of skill in the art, once the ends 80 of the twisted pairs of conductors are positioned in their respective channels 74 the wire lead guide 16 is secured to the wire lead guide receiving surface 24 by inserting the threaded ends 92 of each bolt 86 into its respective threaded bore 90 via the apertures 88 and appropriately tightening the bolt 88.

Figure 8:
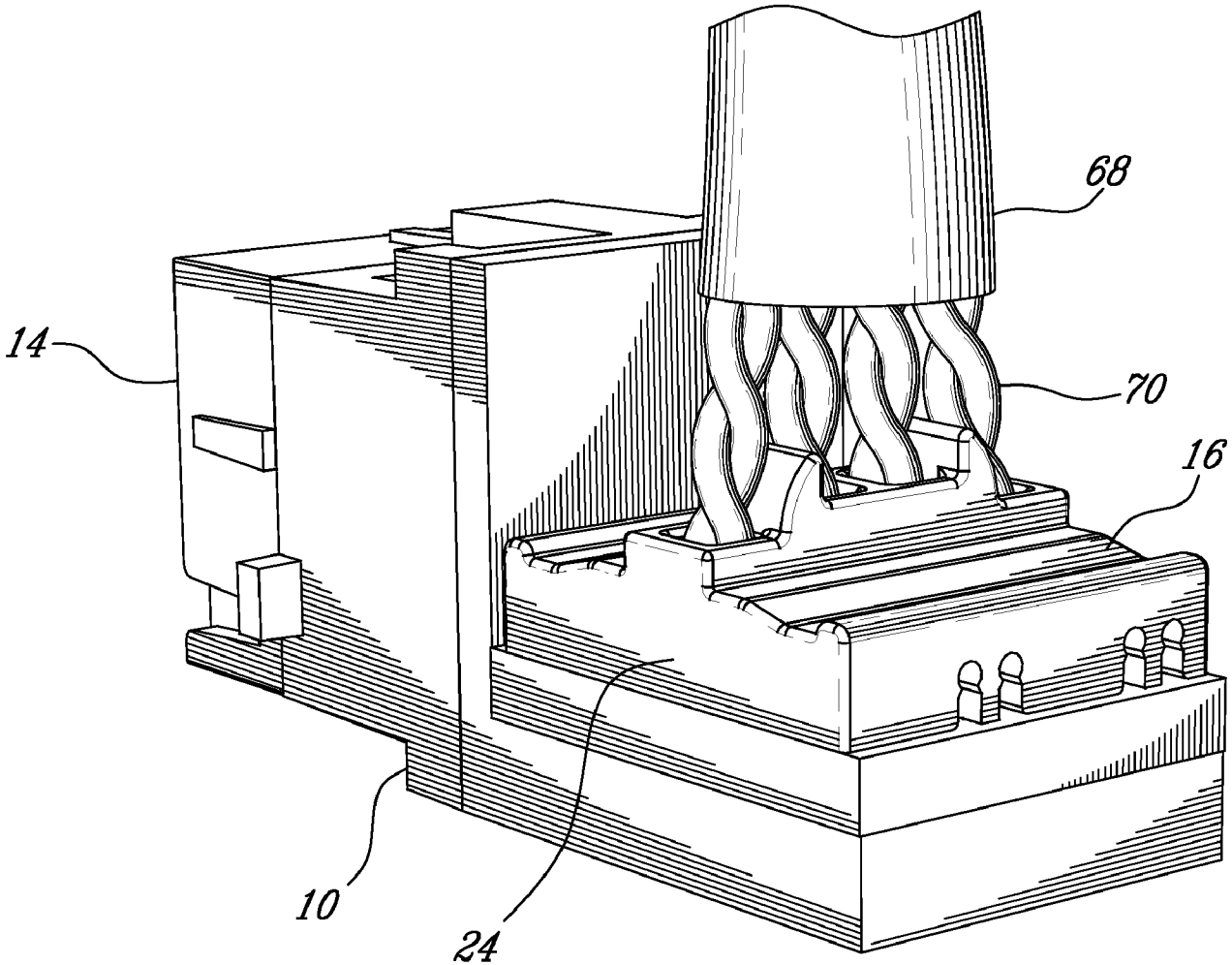
FIG. 8 provides a left raised rear perspective view of an interconnection module with insulation piercing contact in accordance with a second alternative illustrative embodiment of the present invention.

Referring now to FIG. 8, in a second alternative illustrative embodiment of the connector 10 of the present application, the wire lead guide receiving surface 24 and the wire lead guide 16 are both positioned at right angles to the front face 14 of the connector 10 such that a cable 68 can be terminated at right angles without bending.

Figure 9A:
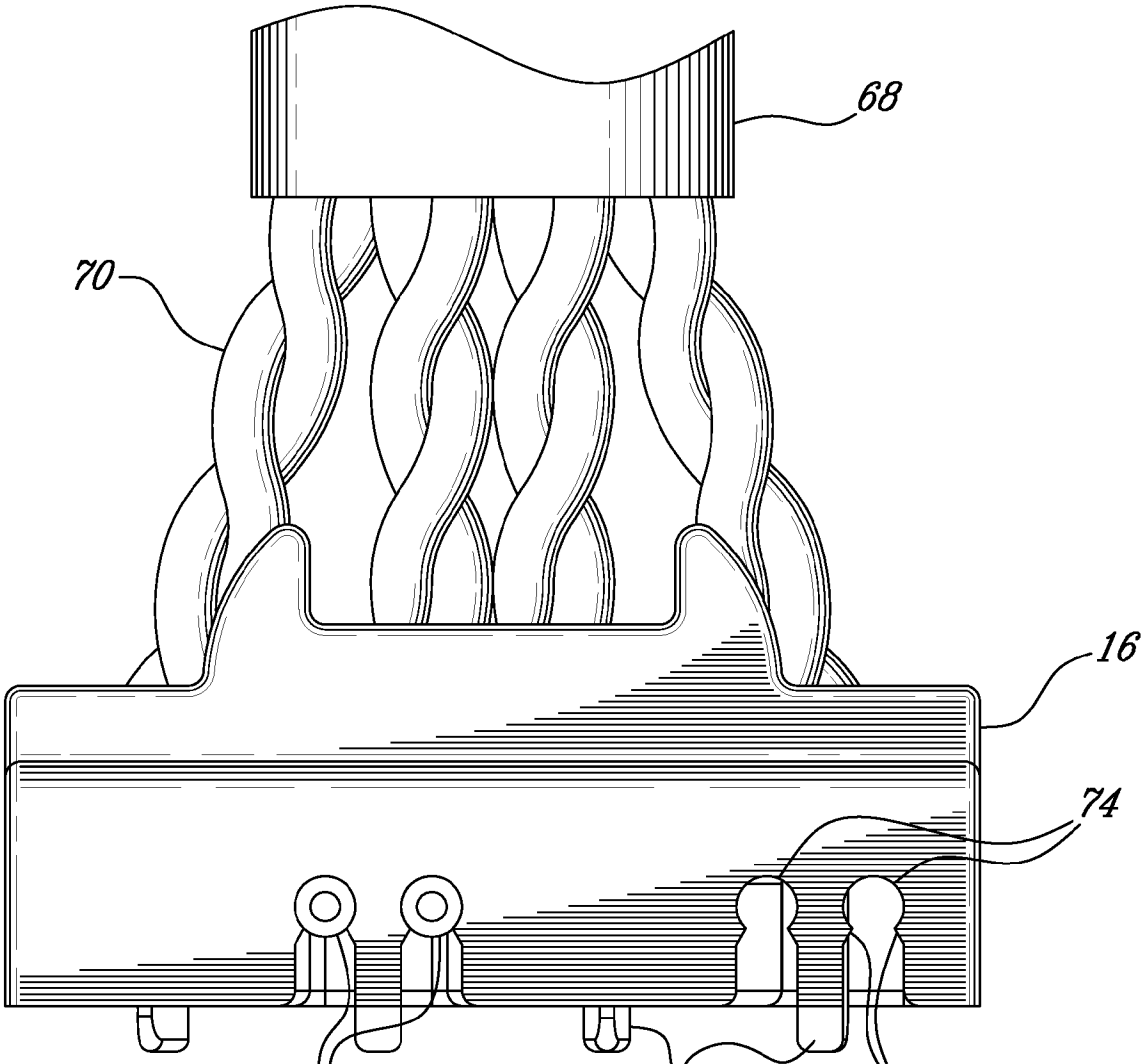
FIGS. 9A, 9B and 9C provide respectively side plan, top plan and bottom plan views of a wire lead guide in accordance with a second alternative illustrative embodiment of the present invention.
Figure 9B:
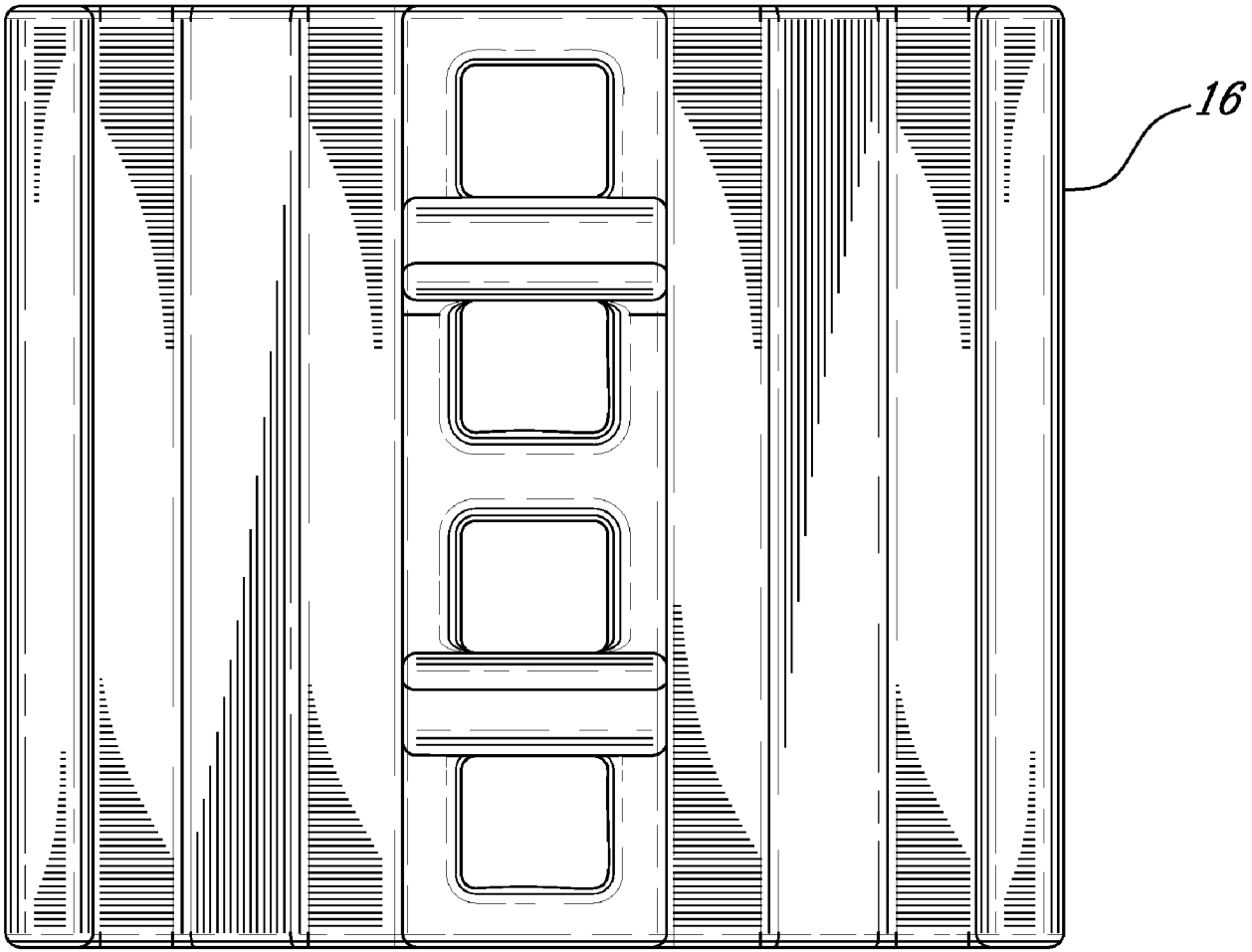
Figure 9C:
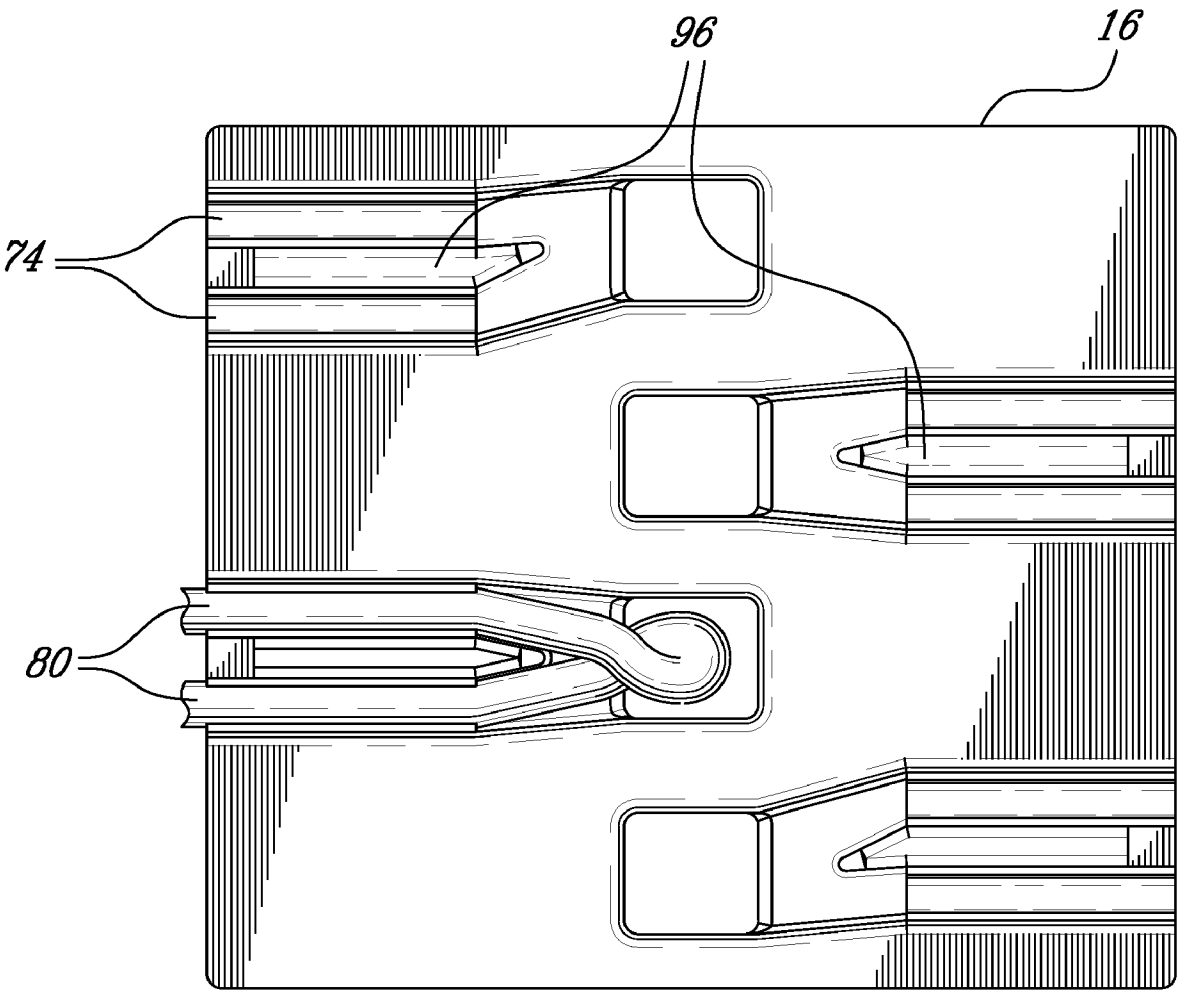

Referring now to FIGS. 9A through 9C, in an alternative illustrative embodiment of the wire lead guide 16 and as illustratively used with the alternative illustrative embodiment of the connector 10 of FIG. 8, the pairs of channels as in 74 are separated by a raised ridge 96 such that each end as in 80 of a given twisted pair as in 70 is slightly separated when inserted into its respective channel as in 74. The ends 80 are retained within their respective channels as in 74 by the pair of opposing ridges as 84. The width of separation between the ends 80 provided by the ridge 96 is chosen taking into consideration the performance of any signal transmission via the twisted pairs 70, and is typically about the distance between conductors of a given twisted pair 70 when in their twisted form. Additionally, the ridge 96 provides some shielding between the conductors of a given twisted pair as in 70.

Figure 10:
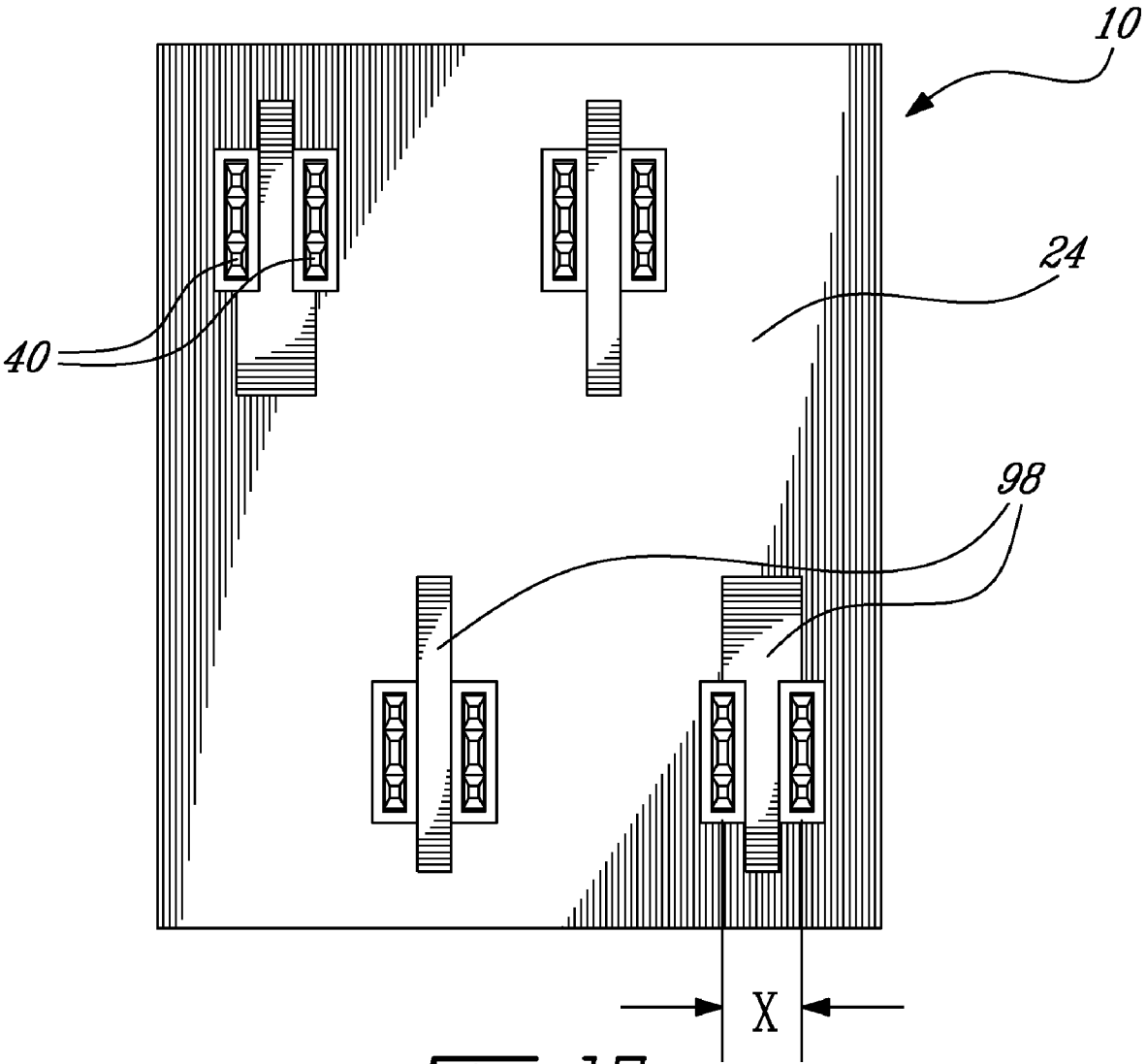
FIG. 10 provides a top plan view with the wire lead guide removed of the interconnection module of FIG. 8.

Referring to FIG. 10, the ridges as in 96 are adapted to mate with corresponding slots 98 machined or otherwise formed in the wire lead guide receiving surface 24 of the connector 10 and into which they are inserted when the wire lead guide 16 is secured to the wire lead guide receiving surface 24. The slots 98 separate the individual pairs of contacts 40. The distance "x" between a given pair of contacts 40 is typically chosen to match that of the distance between conductors of a given twisted pair 66 when in their twisted form.

Figure 11:
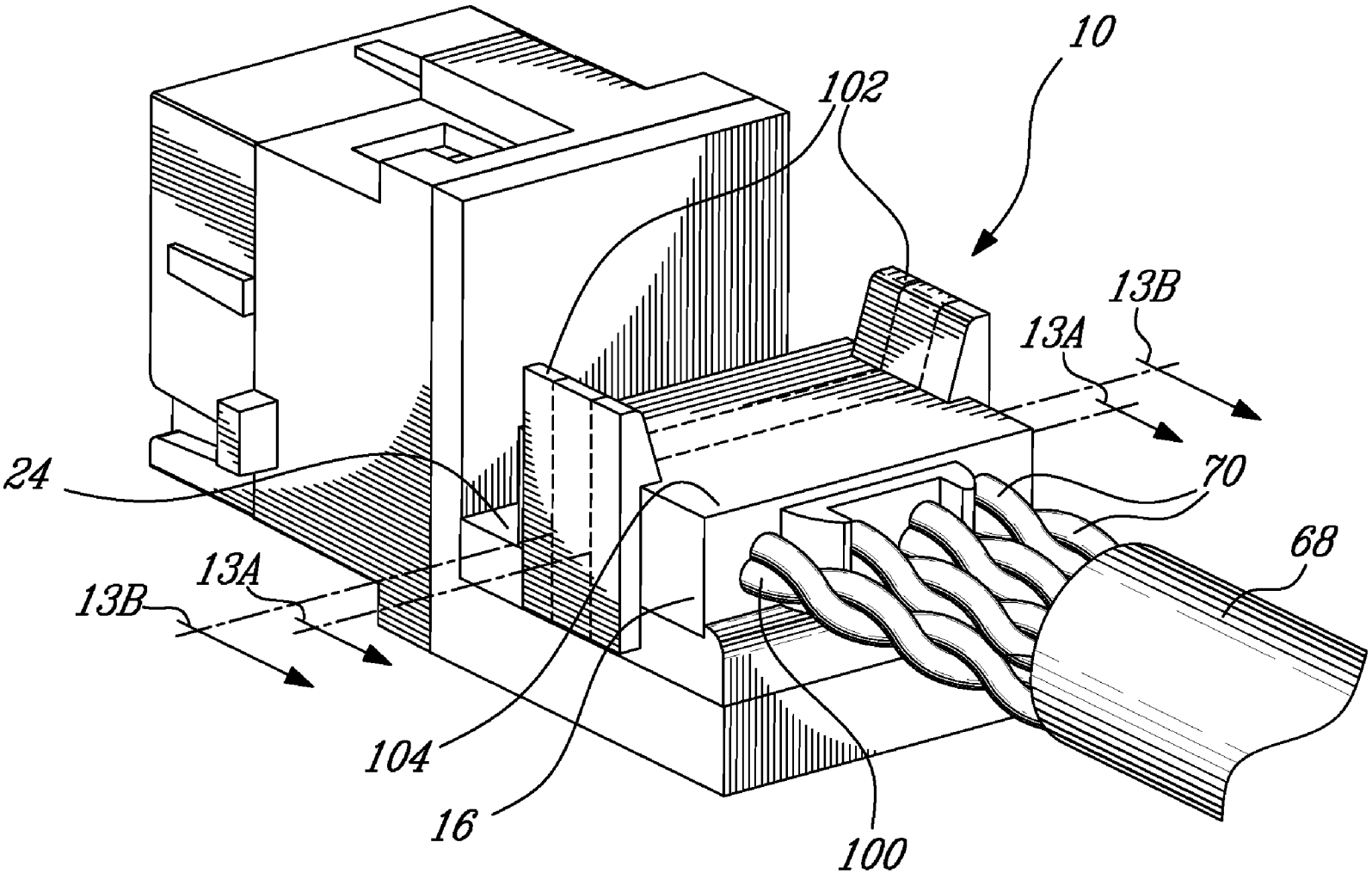
FIG. 11 provides a left raised rear perspective view of an interconnection module with insulation piercing contact in accordance with a third alternative illustrative embodiment of the present invention.

Referring now to FIG. 11, in a third alternative illustrative embodiment of a connector 10 in accordance with the present invention the wire lead guide 16 is comprised of a series of pairs of staggered elongate channels as in 100 which are adapted to receive the twisted pairs of conductors 70 extending from the end of the cable 68. When installed, the wire lead guide 16 is secured to the wire lead guide receiving surface 24 of the connector 10 by a pair of opposed tabs as in 102 which interlock with an upper surface 104 of the wire lead guide 16. Illustratively, the pairs of elongate channels as in 100 are interconnected along the along a length thereof and thus suitable for receiving bonded insulation twisted pair conductors without the necessity of dividing the conductors of a given twisted pair. However, in an alternative embodiment, each channel of a given pair of channels as in 100 could be displaced from one another.

Figure 12:
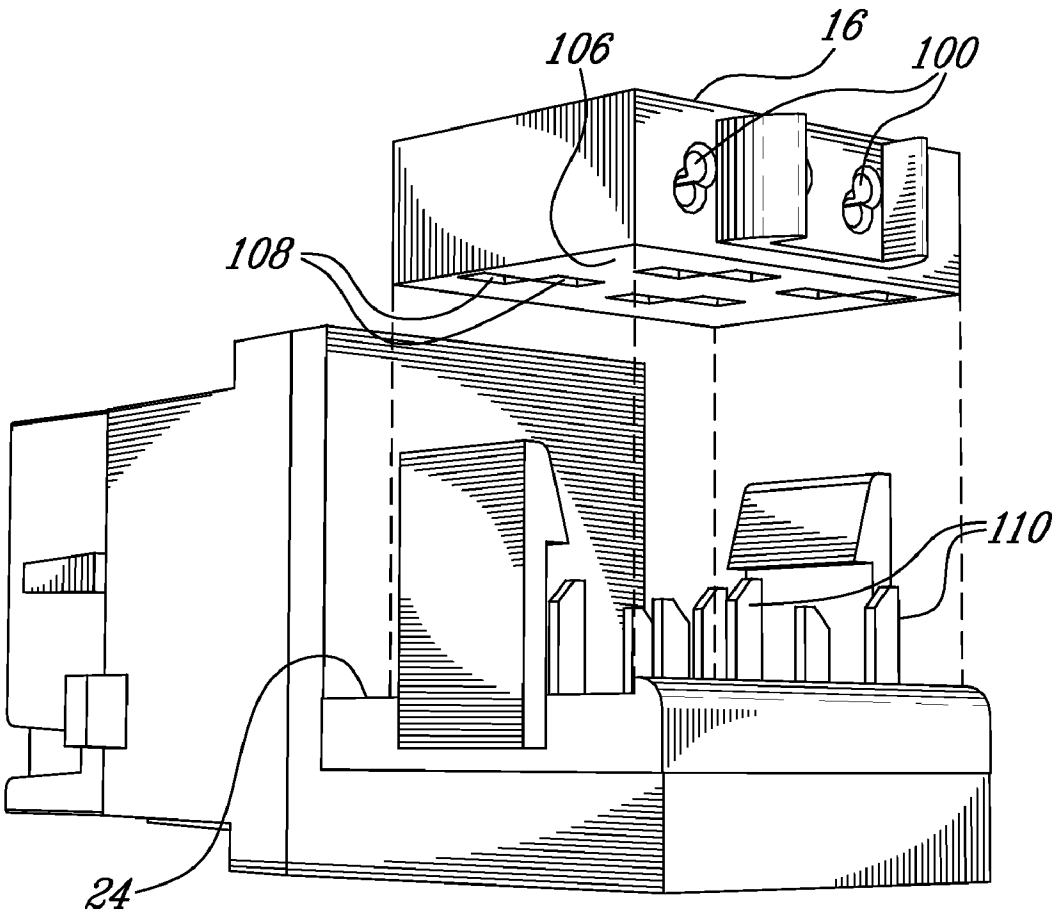
FIG. 12 provides a left raised rear perspective partially exploded view of the interconnection module of FIG. 11.

Referring now to FIG. 12, the lower surface 106 of the wire lead guide 16 is comprised of a series of slots as in 108 which intersect with a respective one of the elongate channels as in 100.

Figure 13A:
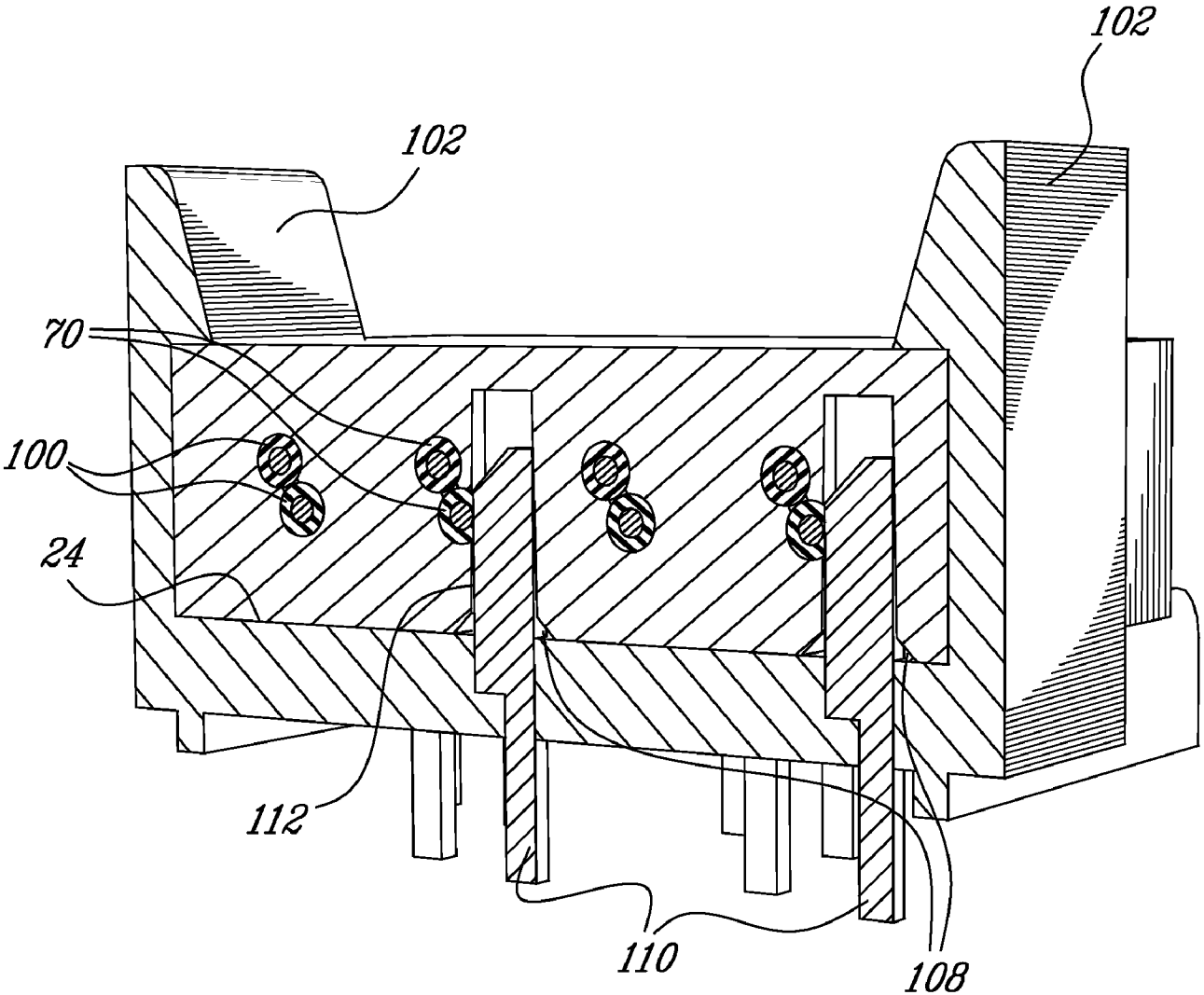
FIGS. 13A and 13B provide right front perspective sectional views respectively along lines 13A-13A and 13B-13B in FIG. 11.
Figure 13B:
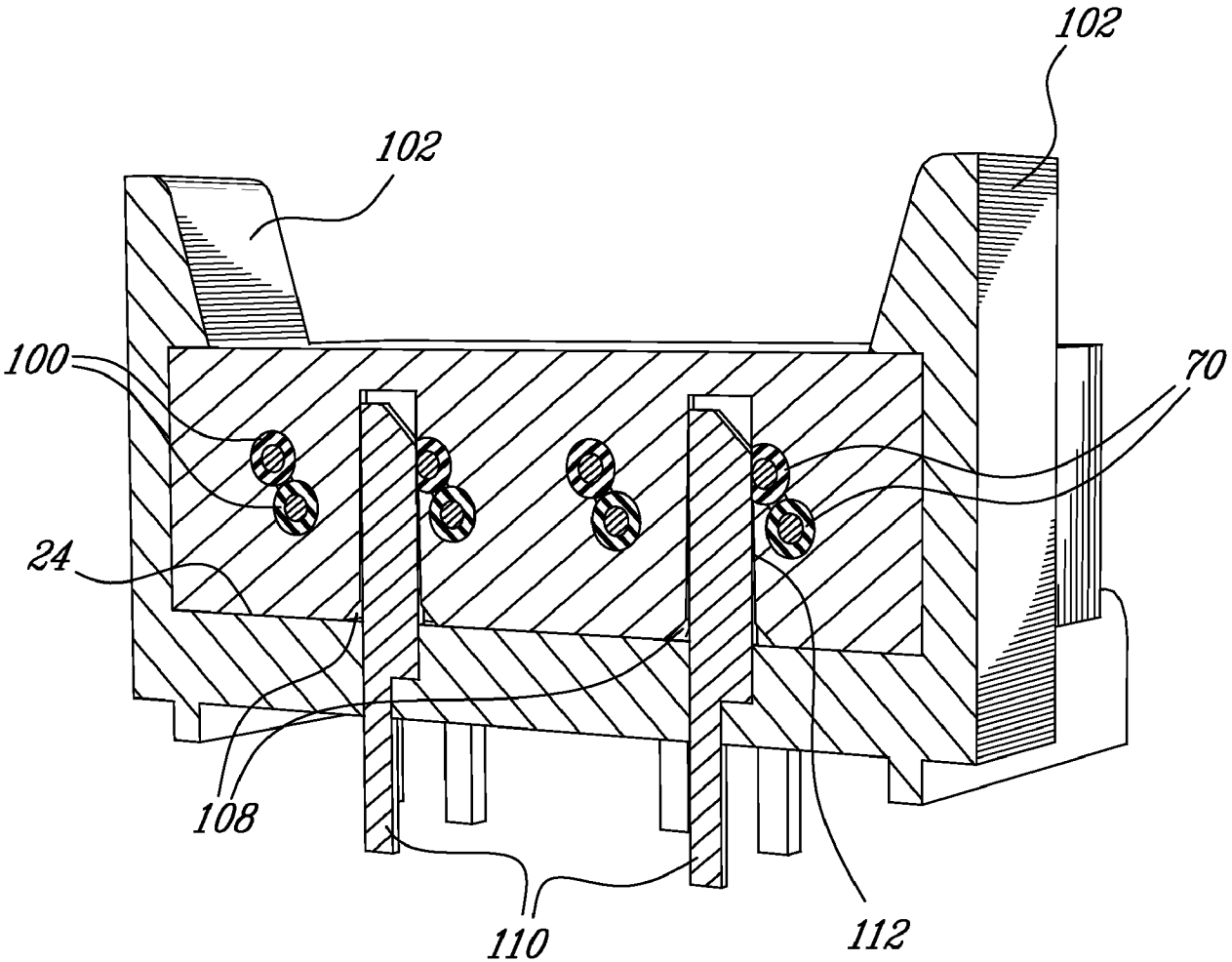

Referring now to FIGS. 13A and 13B, the wire lead guide receiving surface 24 of the connector 10 comprises a series of "half" IDC contacts as in 110 manufactured from a conductive material such as nickel plated copper or the like. Each of the contacts 110 comprises a cutting edge 112. Referring back to FIG. 12 in addition to FIGS. 13A and 13B, in operation the twisted pairs of conductors as in 70 are first inserted into their respective pairs of elongate channels as in 100, the contacts 110 are inserted into their respective slots as in 108 and the wire lead guide 16 secured in between the pair of opposed tabs as in 102. As the conductors 70 are secured in their respective elongate channels as in 100, the cutting edges 112 of each of the contacts 110 displaces the insulation of their respective conductor as in 70 thereby bringing the conductive core of each of the conductors as in 70 into conductive contact with their respective contacts as in 110. Note that, although the contacts as in 110 are shown as terminating a given twisted pair of conductors as in 70 at different points along the length thereof, in an alternative embodiment the contacts as in 110 (with respective changes in the positioning of the slots as in 108) could be arranged opposite each other such that each conductor of the particular twisted pair of conductors as in 70 is terminated at the same point.

Although the present invention has been described hereinabove by way of specific embodiments thereof, it can be modified, without departing from the spirit and nature of the subject invention as defined in the appended claims.

What is claimed is:

1. An electrical connector for terminating a cable comprising a plurality of bonded twisted pairs of conductors, each conductor of the twisted pairs of conductors comprising an insulation surrounding a conductive core, the connector comprising:

a housing defining a plurality of elongate passages, each of said elongate passages configured for receiving only a respective one of the bonded twisted pairs of conductors; and a plurality of pairs of contacts in said housing, each of said pairs of contacts projecting into a respective one of said elongate passages, piercing the insulation and contacting the conductive core of a respective one of the pairs of conductors.

2. The electrical connector of claim 1, wherein said housing further comprises a receptacle adapted for receiving a cable plug comprising a plurality of pairs of terminals, said receptacle comprising a plurality of pairs of conductive tines disposed therein, each of said tines coming into contact with a respective one of the terminals when the plug is inserted into said receptacle, and wherein each of said contacts is electrically interconnected with a respective one of said tines.

3. The electrical connector of claim 1, wherein each of said passages comprises a pair of like straight elongate bores arranged in parallel and adjoining along a length thereof, each of said bores having a cross sectional diameter sized for snugly receiving one of the conductors.

4. The electrical connector of claim 1, wherein said contacts are piercing contacts.

5. The electrical connector of claim 4, wherein each of said pairs of piercing contacts is substantially flat and arranged opposite one another.

6. The electrical connector of claim 1, wherein said contacts are half IDC contacts.

7. The electrical connector of claim 6, wherein each of said half IDC contacts are flat and lie in parallel planes.

8. The electrical connector of claim 2, wherein the cable plug is an RJ-45 style plug, and said receptacle is adapted to receive an RJ-45 style plug.

* * * * *